US006676241B2

(12) United States Patent
Yabe

(10) Patent No.: US 6,676,241 B2
(45) Date of Patent: Jan. 13, 2004

(54) INK JET HEAD, PRODUCING METHOD THEREFOR AND INK JET RECORDING APPARATUS

(75) Inventor: Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/077,799

(22) Filed: Feb. 20, 2002

(65) Prior Publication Data

US 2002/0122101 A1 Sep. 5, 2002

(30) Foreign Application Priority Data

Feb. 23, 2001 (JP) ..... 2001-048665

(51) Int. Cl.[7] ..... B41J 2/015; B41J 2/05; B41J 2/175

(52) U.S. Cl. ..... 347/20; 347/63; 347/93

(58) Field of Search ..... 347/63, 65, 67, 347/56, 61, 20, 93, 94, 44, 45, 47

(56) References Cited

U.S. PATENT DOCUMENTS

| | | | | |
|---|---|---|---|---|
| 4,657,631 A | | 4/1987 | Noguchi | 156/655 |
| 5,095,321 A | * | 3/1992 | Saito et al. | 347/63 |
| 5,335,004 A | | 8/1994 | Matsuhisa | 347/44 |
| 5,484,823 A | * | 1/1996 | Noguchi et al. | 347/63 |
| 6,183,067 B1 | | 2/2001 | Matta | 347/65 |
| 6,286,939 B1 | * | 9/2001 | Hindman et al. | 347/63 |
| 6,390,606 B1 | * | 5/2002 | Terui et al. | 347/63 |

FOREIGN PATENT DOCUMENTS

| | | | |
|---|---|---|---|
| EP | 0 863 005 | 9/1998 | B41J/2/14 |
| JP | 61 154947 | 7/1986 | B41J/3/04 |
| JP | 3 184868 | 8/1991 | B41J/2/16 |

* cited by examiner

*Primary Examiner*—Thinh Nguyen
*Assistant Examiner*—Juanita Stephens
(74) *Attorney, Agent, or Firm*—Fitzpatrick, Cella, Harper & Scinto

(57) ABSTRACT

An ink jet head comprises a substrate bearing a liquid discharge pressure generating element for generating energy for discharging liquid from a discharge port, a flow path forming member adjoined to the substrate and forming a flow path communicating with the discharge port through a position on the liquid discharge pressure generating element, and an adhesion layer formed in at least a part between the substrate and the flow path forming member and having an adhesion force with respect to the substrate and the flow path forming member larger than an adhesion force between the flow path forming member and the base, wherein the adhesion layer is formed, in a portion where the stress in the flow path forming member is concentrated in a direction of peeling from the substrate, in an area wider than the adjoining area between the flow path forming member and said adhesion layer.

22 Claims, 13 Drawing Sheets

INK JET HEAD, PRODUCING METHOD THEREFOR AND INK JET RECORDING APPARATUS

BACKGROUND OF THE INVENTION

1. Field of the Invention

The present invention relates to an ink jet head for forming an image by discharging ink (liquid) for deposition onto a recording medium, and more particularly to an ink jet head provided with a substrate bearing a discharge pressure generating element for generating a pressure for discharging ink, a flow path forming member adhered to the substrate for constituting an ink flow path, and a jointing layer for increasing the adhesion force between the substrate and the flow path forming member.

2. Related Background Art

Among the recording method employed in the printer or the like, the ink jet recording method of discharging ink from a discharge port onto a recording medium for forming a character or an image is recently employed widely as it is a non-impact recording system of low noise level capable of high-speed recording operation at a high density.

In general, the ink jet recording apparatus is provided with an ink jet head, a carriage for supporting such ink jet head, drive means for such carriage, conveying means for conveying a recording medium, and control means for controlling these components. The apparatus executing the recording operation under the movement of the carriage is called serial type. On the other hand, the apparatus executing the recording operation by the conveying operation of the recording medium, without the movement of the ink jet head, is called line type. In the ink jet recording apparatus of line type, the ink jet head is provided with a plurality of nozzles arranged over the entire width of the recording medium.

In the ink jet head, for the ink discharge pressure generating element for generating the pressure for discharging the ink droplet from the discharge port, there are known an electromechanical converting element such as a piezo element, an electrothermal converting element such as a heat generating resistor, or an electromagnetic wave-mechanical converting element or an electromagnetic wave-thermal converting element utilizing electric wave or laser light. Among these, the ink jet head of so-called bubble jet method utilizing a heat generating resistor for the ink discharge pressure generating element and inducing film boiling in the ink for generating a bubble thereby discharging ink, is effective for high-definition recording because the pressure generating elements can be arranged at a high density. Such ink jet head is generally provided with plural discharge ports, plural discharge pressure generating elements, and flow paths for guiding the ink, supplied from an ink supply system, through the discharge pressure generating elements to the discharge ports.

For forming an ink jet head by adjoining a flow path forming member for forming an ink flow path to a substrate bearing the discharge pressure generating element, there have conventionally been proposed various methods. For example, the Japanese Patent Application Laid-open No. 61-154947 discloses a method of forming a flow path pattern with soluble resin on a substrate bearing a discharge pressure generating element, then forming thereon and hardening a resin layer such as of epoxy resin so as to cover the flow path pattern, and, after the cutting of the substrate, dissolving out the soluble resin. Also the Japanese Patent Application Laid-open No. 3-184868 discloses that it is effective to employ a cationic polymerized and hardened substance of an aromatic epoxy compound as the covering resin for the flow path pattern.

In these producing methods, the adjoining of the substrate bearing the discharge pressure generating element and the flow path forming member is by the adhesion force of the resin constituting the flow path forming member.

In the ink jet head, the flow path is constantly filled with the ink in the normal state of use, so that the periphery of the adjoining portion between the substrate bearing the ink discharge pressure generating element and the flow path forming member is in contact with the ink. Therefore, if the adjoining is achieved by the adhesion force only of the resinous material constituting the flow path forming member, the adhesion of the adjoining portion may be deteriorated in time by the influence of the ink.

Also in the ink jet recording apparatus, it is recently required to execute recording on recording media of various materials and to provide the recorded image with water resistance, and weakly alkaline ink may be employed for meeting such requirements. Particularly in case of such weakly alkaline ink, it may become difficult to maintain the adhesion force between the substrate bearing the ink discharge pressure generating element and the flow path forming member over a prolonged period.

Also in so-called bubble jet head, in order to suppress damage in the heat generating resistor etc. by electroerosion caused by the ink or by cavitation at the extinction of the bubble, it is common to form an inorganic insulation layer composed for example of SiN or $SiO_2$ and an anticavitation layer composed for example of Ta particularly on the heat generating resistor. Such Ta layer has a lower adhesion force than the SiN layer to the resinous material constituting the flow path forming member. For this reason, the flow path forming member may be peeled off from the Ta layer under severe conditions.

Such peeling of the flow path forming member from the substrate changes the shape of the flow path, thereby changing the ink discharge characteristics and detrimentally affecting the image formation. In order to prevent such phenomenon, according to the Japanese Patent Application Laid-open No. 11-348290 discloses it is effective to form an adhesion layer composed of polyetheramide resin between the substrate and the flow path forming member. According to the above-mentioned patent application, excellent adhesion can be maintained over a long period both in case of using the alkaline ink or in case of adjoining the flow path forming member on a Ta layer.

A conventional ink jet head having such adhesion layer is shown in FIGS. 20A and 20B which are respectively a horizontal cross-sectional view partly showing the vicinity of the flow path of such ink jet head and a cross-sectional view along a line 20B—20B in FIG. 20A.

Such ink jet head is provided, on a substrate 51, with a flow path wall 61 and a ceiling portion (not shown) formed thereon and having a discharge port 59, by the aforementioned flow path forming member 58 of a resinous material. The discharge ports 59 are opened in opposed relationship to plural ink discharge pressure generating elements (not shown) provided on the substrate 51. The flow path wall 61 is formed in plural units in comb-tooth shape, and, between the adjacent flow path walls, there is formed a flow path for guiding the ink from the lower side of FIG. 20A onto each ink discharge pressure generating element. At the entrance of each flow path, there are formed vertically extending two pillars 62 with a predetermined gap therebetween, for example in order to prevent dust intrusion into the flow path.

The flow path forming member 58 is adjoined to the substrate 51 across an adhesion layer 56. Stated differently, the adhesion layer 56 is formed between the flow path forming member 58 and the substrate 51. In such configuration, if the adhesion layer 56 is formed over a planar area wider than the flow path forming member 58, there is formed, in the flow path, a step difference at the boundary between an area bearing the adhesion layer 56 and an area lacking the adhesion layer 56. Such step difference may complicate the flowability of the ink in the flow path and render it unstable, thereby hindering the desired stable ink flow. Also if the adhesion layer 56 is provided on the ink discharge pressure generating element, loss in the transmission of the discharge energy to the ink becomes large since the discharge energy from the ink discharge pressure generating element has to be transmitted to the ink through the adhesion layer 56. Also the discharge energy may apply a force or heat to the adhesion layer 56, thereby stimulating peeling thereof. Therefore, the adhesion layer 56 is preferably provided in a planar area excluding the area of the ink discharge pressure generating element. For this reason, the adhesion layer 56 is conventionally provided in a planar area narrower than the flow path forming member 58.

The aforementioned ink jet head, however, is associated with a drawback that the flow path forming member 58 may be peeled off by a physical stress applied thereto. Such phenomenon will be explained in the following with reference to FIGS. 21A, 21B and 33 which are respectively a lateral cross-sectional view of a conventional ink jet head, a magnified view of an adjoining portion of the flow path forming member 58 to the substrate 51, and a partial horizontal cross-sectional view of the vicinity of the flow path.

In such ink jet head, in the vicinity of the center of the substrate 51, an ink supply aperture 66 is formed by an etching process employing an ink supply aperture mask 53. On both sides of the ink supply aperture 60 on the substrate 51, in a direction perpendicular to the plane of FIG. 21A, there are arranged plural ink discharge pressure generating elements 52 and control signal input electrodes for driving these elements. On these elements there is formed a protective SiN layer 54, and an anticavitation Ta layer 55 is formed on the ink discharge pressure generating element 52. On the SiN layer 54, there is adjoined, across an adhesion layer 56, the flow path forming member 58 which constitutes the flow path wall 61 forming the flow path and the ceiling portion including the discharge port 59.

In such ink jet head, the flow path forming member 58 composed of a resinous composition may be swelled by prolonged contact with the ink. Such swelling generates, in the flow path forming member 58, a stress spreading from the center to the peripheral part, as indicated by an arrow in FIGS. 21A and 21B, whereby a stress is generated in the adjoining portion between the flow path forming member 58 and the substrate 51 from the interior toward the exterior so as to induce peeling of the flow path forming member 58. Such stress tends to be particularly concentrated in a front end portion of the flow path wall 61 in a direction toward the ink supply aperture 60. In the conventional configuration, a portion of the flow path forming member 58 is directly adjoined to the SiN layer 54 without the adhesion layer 56 therebetween in the vicinity of the front end of the liquid path wall 61 as explained in the foregoing, so that the peeling of the flow path forming member 58 may occur in such portion as illustrated in FIG. 21B.

Also in case of generation of such mechanical stress, in the portion where the flow path forming member 58 is adjoined to the Ta layer 55 across the adhesion layer 56, though the adhesion force between the flow path forming member 58 and the adhesion layer 56 is relatively large, that between the adhesion layer 56 and the Ta layer 55 is smaller in comparison, so that the peeling may occur between the adhesion layer 56 and the Ta layer 55 while the flow path forming member 58 and the adhesion layer 56 remain adjoined.

Such peeling of the flow path forming member 58, if generated in the portion of the flow path wall 61, significantly changes the flowability of ink in the flow path, thereby varying the ink discharge characteristics and detrimentally affecting the recorded image.

In order to achieve further increase in the recording speed of the ink jet recording apparatus, there is currently investigated the manufacture of a longer ink jet head having 600 to 1300 discharge ports per head. In such longer ink jet head, the flow path forming member 58 will have a larger contact area with the ink, and a large stress may be generated by swelling.

Also the ink flow is a factor causing the physical stress in the flow path forming member 58. At the ink flow into the flow path for replenishment after the ink discharge or at the ink filling into the ink jet head at the start of use thereof, the ink flow applies a physical stress to the flow path forming member 58. Such stress also tends to be concentrated in the front end portion of the flow path wall 61 in case it is formed in comb-tooth shape.

SUMMARY OF THE INVENTION

In consideration of the foregoing, the object of the present invention is to provide an ink jet head, constructed by adjoining a flow path forming member constituting an ink flow path to a substrate, capable of increasing the adjoining force of the substrate and the flow path forming member to prevent peeling thereof even in case a stress is applied to the adjoining portion between the substrate and the flow path forming member for example by swelling thereof, thereby enabling satisfactory recording operation in highly reliable manner over a long period, and a method for producing such ink jet head.

The above-mentioned object can be attained, according to the present invention, by an ink jet head comprising:

- a substrate bearing a liquid discharge pressure generating element for generating energy for liquid discharge from a discharge port;
- a flow path forming member adjoined on the substrate and forming a flow path communicating with the discharge port through position on the liquid discharge pressure generating element; and
- an adhesion layer formed at least in a part between the substrate and the flow path forming member and having an adhesion force with respect to the substrate and the flow path forming member larger than that between the flow path forming member and the base;
- wherein the adhesion layer is formed in a position where a stress generated in the flow path forming member in a direction for peeling from the substrate is concentrated and is in an area wider than the adjoining area between the flow path forming member and the adhesion layer.

Such configuration allows to increase the adhesion force between the flow path forming member and the substrate in a portion where the stress is concentrated in the flow path forming member in a direction for peeling from the substrate, thereby effectively suppressing the peeling of the flow path forming member from the substrate. In such configuration, the adhesion layer may be so formed as to overflow from the flow path forming member only in a portion where the stress is concentrated, so that the overflowing portion into the liquid flow path need not be made large thereby minimizing the influence on the flowability of the liquid.

In the ink jet head of the aforementioned configuration, there may be generated a stress by the swelling of the flow path forming member, principally in a direction from the common liquid chamber toward the peripheral portions. Consequently, the stress generated by the swelling is concentrated at the end portion of the flow path wall extending toward the common liquid chamber, in such a direction as to induce peeling of the flow path wall. Also the stress tends to be generated at such end portion of the flow path wall by the ink flow. Therefore, by forming the adhesion layer at the end portion of the flow path wall, over a planar area wider than the adjoining area between the flow path wall and the substrate, it is rendered possible to increase the adhesion force between the end portion of the flow path wall and the substrate, thereby effectively suppressing the peeling phenomenon in such portion.

In such configuration, the overflowing portion of the adhesion layer from the flow path forming member is present at the root portion of the flow path relatively distant from the discharge port for liquid discharge, thus having a relatively small influence on the liquid flowability in the flow path. In other portions of the flow path, the adhesion layer is preferably formed within an area included in the adjoining area of the flow path wall at the root side thereof, so as not to overflow from the flow path forming member. Also in case the flow path wall is very narrow in width, the adhesion layer may be dispensed with at the root side of the flow path wall. Even in such case, the flow path wall is difficult to be peeled off as the adhesion force thereof is increased by the adhesion layer at the front end portion thereof.

Also in case plural flow path walls are formed with a particularly small pitch, the adhesion layer may be formed in a belt-like shape so as to pass through the adjoining portions of the front end portions of such plural flow path walls. Such configuration allows to effectively increase the adhesion force between the front end portions of the flow path walls and the substrate by the adhesion layer of a sufficient area even for the flow path walls formed with a very small pitch.

Also in the ink jet head of the configuration of the present invention, there may be provided a pillar, composed of the flow path forming member, in the vicinity of the entrance of the flow path and in an area distant from the area of the flow path wall. For example such pillar may have a filter function for preventing entry of undesirable substance into the flow path. Also in such case, the adhesion layer may also be formed in an area passing through a planar area where the pillar is formed.

Also, such pillar need not necessarily be adjoined to the substrate and the ceiling formed by the flow path forming member. Therefore, the adhesion layer may be formed excluding the area of the pillar, or may be formed in the planar area of the pillar, independently from other areas. There may also be conceived a configuration in which the pillar extends from the ceiling, formed by the flow path forming member, toward the substrate to a position distanced from the adhesion layer, or a configuration in which the pillar extends from the adhesion layer toward the ceiling formed by the flow path forming member, to a position distanced from the ceiling.

The adhesion layer to be formed in the planar area passing through the area of the pillar can be, for example, an adhesion layer for protecting the rim of the liquid supply aperture, formed in an area surrounding the rim of the liquid supply aperture, formed in the substrate, so as to partly overflow in the liquid supply aperture.

In the ink jet head of the present invention, the adhesion layer is so formed as to overflow partially from the flow path forming member, and is preferably formed in an area excluding the area of the liquid discharge pressure generating element. In this manner the energy generated by the liquid discharge pressure generating element can be efficiently transmitted to the liquid without going through the adhesion layer. Also there can be prevented the peeling tendency of the adhesion layer induced by the energy generated by the liquid discharge energy generating element.

In the present invention, the adhesion layer can be advantageously composed of polyetheramide resin, particularly thermoplastic polyetheramide resin. Also the flow path forming member can be advantageously composed of a resinous material, particularly a cationic polymerized substance of epoxy resin.

In particular, the present invention is advantageously applicable to an ink jet head in which the discharge port is formed in a position opposed to the liquid discharge pressure generating element, and also to an ink jet head employing an electrothermal converting member as the liquid discharge pressure generating element.

For forming the ink jet head of the present invention, there is advantageously adopted a method comprising steps of:

- coating the substrate with a resinous material for constituting the adhesion layer and patterning the resinous material into a predetermined planar shape thereby forming the adhesion layer;
- coating thereon a soluble resinous material and patterning the soluble resinous material into a predetermined planar shape to form a flow path pattern;
- coating thereon a resinous material for constituting the flow path forming member;
- opening a discharge port in the resinous material for constituting the flow path forming member; and
- dissolving out the resinous material constituting the flow path pattern.

In particular, the resinous material for constituting the adhesion layer can be advantageously composed of polyetheramide resin, and the layer of polyetheramide resin coated on the substrate can be advantageously patterned by oxygen plasma ashing.

DESCRIPTION OF THE PREFERRED EMBODIMENTS

Now the present invention will be clarified in detail by embodiments thereof, with reference to the accompanying drawings.

<First Embodiment>

Figure 1A:
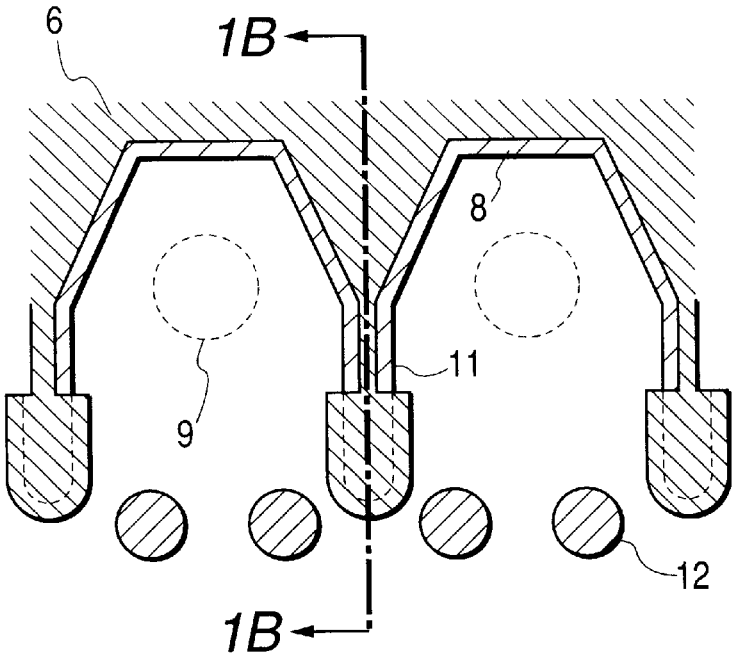
FIGS. 1A and 1B are schematic cross-sectional views showing an ink jet head constituting a first embodiment of the present invention, and are respectively a horizontal cross-sectional view showing a part in the vicinity of flow paths and a cross-sectional view along a line 1B—1B in FIG. 1A.
Figure 1B:
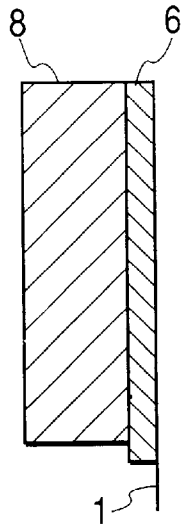
Figure 2:
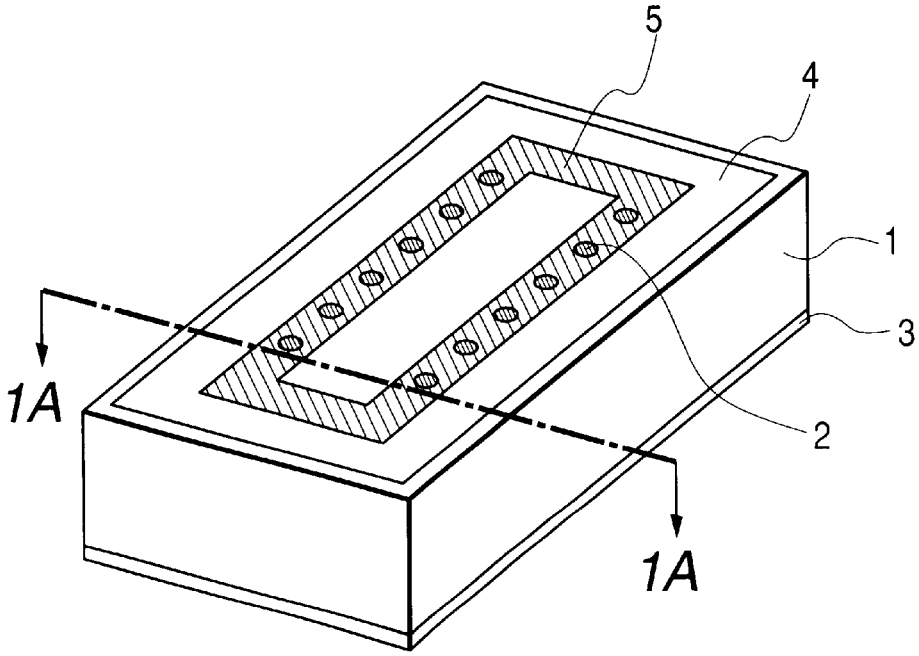
FIG. 2 is a perspective view showing a certain stage in the process for producing the ink jet head shown in FIGS. 1A and 1B.

The first embodiment of the present invention will be explained with reference to FIGS. 1A, 1B and 2 to 8. FIGS. 1A and 1B are schematic cross-sectional views showing an ink jet head constituting the first embodiment of the present invention, wherein FIGS. 1A and 1B are respectively a horizontal cross-sectional view showing a part in the vicinity of flow paths and a cross-sectional view along a line 1B—1B in FIG. 1A. FIGS. 2 to 8 are schematic view showing different stages in a process for producing the ink jet head of the present embodiment, wherein FIG. 2 is a perspective view showing the entire ink jet head while FIGS. 3 to 8 are cross-sectional views along a line 1A—1A in FIG. 2.

The ink jet head of the present embodiment is similar to the conventional ink jet head explained in the foregoing, with respect to the shape and arrangement of an ink supply aperture 10 formed in a substrate 1, a flow path wall 11 formed by a flow path forming member 8 and a ceiling portion including a discharge port 9.

More specifically, the substrate 1 is provided in the vicinity of the center thereof with an ink supply aperture 10 having an oblong rectangular planar shape. On the substrate 1, there are formed plural ink discharge pressure generating elements 2 on both sides of the ink supply aperture 10 and along the longitudinal direction thereof. In the present embodiment, an electrothermal converting element consisting of TaN is employed as the ink discharge pressure generating element 2, and the substrate 1 is provided thereon with control signal input electrodes (not shown) for driving the electrothermal converting elements.

The substrate 1 is further provided thereon with a SiN layer 4 so as to cover the substantially entire surface of the substrate 1 for protecting these elements and electrodes, and also with a Ta layer 5 in a position covering the ink discharge pressure generating element 2. In the present embodiment, the Ta layer 5 is formed continuously between those on the adjacent ink discharge pressure generating elements 2 whereby it is formed in a belt-like shape along the array direction thereof. Also such Ta layers formed in the belt-like shape on both sides of the ink supply aperture 10 are mutually connected at the ends in the array direction of the ink discharge pressure generating elements 2 to constitute an entirely connected Ta layer 5.

On these components, the flow path forming member 8 of epoxy resin forms a flow path wall 11 and thereon a ceiling portion including the discharge port 9. Also there is formed, on the ink supply aperture 10, a common liquid chamber for containing the ink to be supplied to the discharge ports 9. The discharge ports 9 are formed above and in opposed relationship to the plural ink discharge pressure generating elements 2 formed on the substrate 1. The flow path walls 11 are formed in a comb-tooth shape, thereby forming, between each pair of flow path walls 11, a flow path extending from the common liquid chamber to a position on each discharge pressure generating element 2. Such flow path and the discharge port 9 constitute a nozzle.

In such configuration, since the Ta layer 5 is provided in a planar area as explained in the foregoing, the flow path wall 11 is positioned not only on the SiN layer 4 but also on the Ta layer 5. At the entrance of each flow path, there are provided vertically extending two pillars 12 with a predetermined gap therebetween for example in order to prevent entry of dusts into the flow path.

Between the flow path forming member 8 and the SiN layer 4, there is formed an adhesion layer 6 composed of polyetheramide. In the ink jet head of the present embodiment, the pattern of formation of the adhesion layer 6 is different from that in the conventional configuration. More specifically, the adhesion layer 6 is formed in a planar area narrower than the flow path forming member 8 except for the front end portion of the flow path wall 11 formed by the flow path forming member 8, but is formed in a planar area wider than the flow path forming member 8 in the front end portion of the flow path wall 11. More specifically, the flow path wall 11 has a width of about 10 $\mu$m, while the adhesion layer 6 has a width of about 15 $\mu$m in the front end portion of the flow path and about 5 $\mu$m in an interim portion.

In the following there will be explained the method for producing the ink jet head of the present embodiment.

Figure 3:
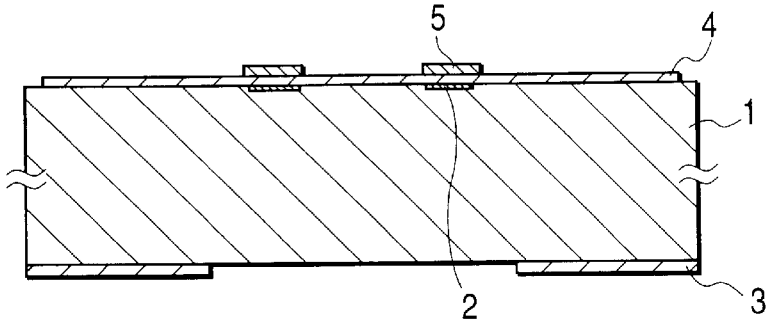
FIG. 3 is a schematic cross-sectional view along a line 1A—1A in FIG. 2.

At first an Si wafer of crystalline orientation <100> was employed as the substrate 1, and the ink supply aperture mask 3 was formed on the lower surface excluding a portion to constitute the ink supply aperture 10. Then the ink discharge pressure generating elements 2 and the control signal input electrodes (not shown) were formed on the upper surface of the substrate 1. Then formed thereon were the SiN layer 4 as a protective layer and the Ta layer 5 as an anticavitation layer. FIGS. 2 and 3 schematically show the ink jet head in this stage.

Then, on the substrate 1, there was formed the polyeitheramide layer with a thickness of 2.0 $\mu$m for constituting the adhesion layer 6. The polyetheramide, composed of HIMAL1200 (trade name) supplied by Hitachi Chemical Industries Co., was coated on the substrate 1 by a spinner and was baked under heating for 30 minutes at 100° C. and then for 1 hour at 250° C.

Figure 4:
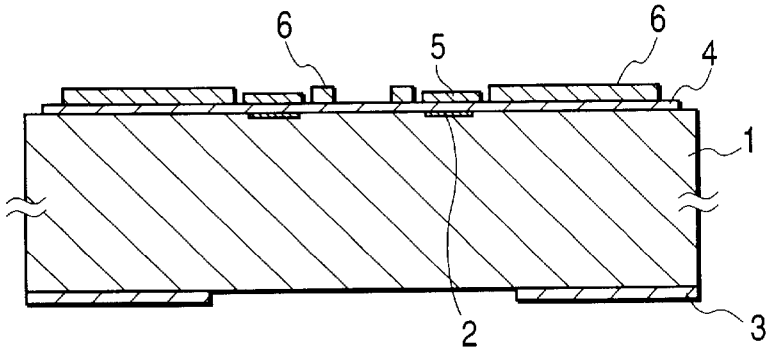
FIG. 4 is a schematic cross-sectional view in another stage in the process for producing the ink jet head shown in FIGS. 1A and 1B.

Then, thus prepared polyetheramide layer was patterned by forming, on the polyetheramide layer, photoresist OFPR800 (trade name) supplied by Tokyo Oka Co. in a predetermined pattern, then executing etching by oxygen plasma ashing utilizing such pattern as a mask, and finally peeling off the OFPR photoresist pattern used as the mask. In this manner there was formed the adhesion layer 6 of the predetermined pattern as shown in FIGS. 1A, 1B and 4.

Figure 5:
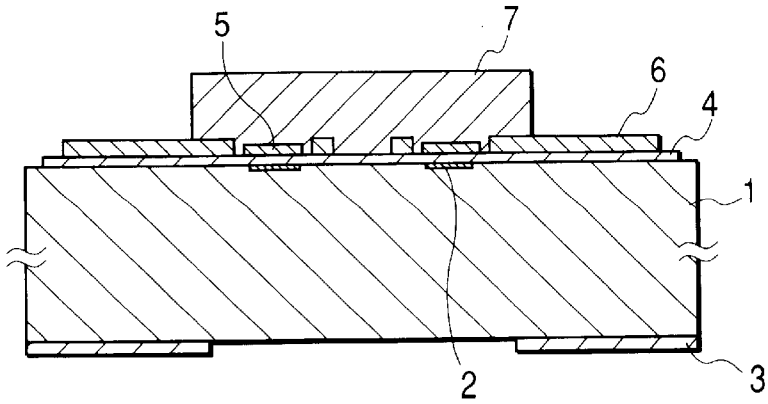
FIGS. 5 to 8 are schematic cross-sectional views in still other stages in the process for producing the ink jet head shown in FIGS. 1A and 1B.

Then positive photoresist ODUR (trade name) supplied by Tokyo Oka Co. was coated on the substrate 1 with a thickness of 12 $\mu$m and was patterned to have a desired flow path pattern thereby obtaining the flow path pattern as shown in FIG. 5.

Figure 6:
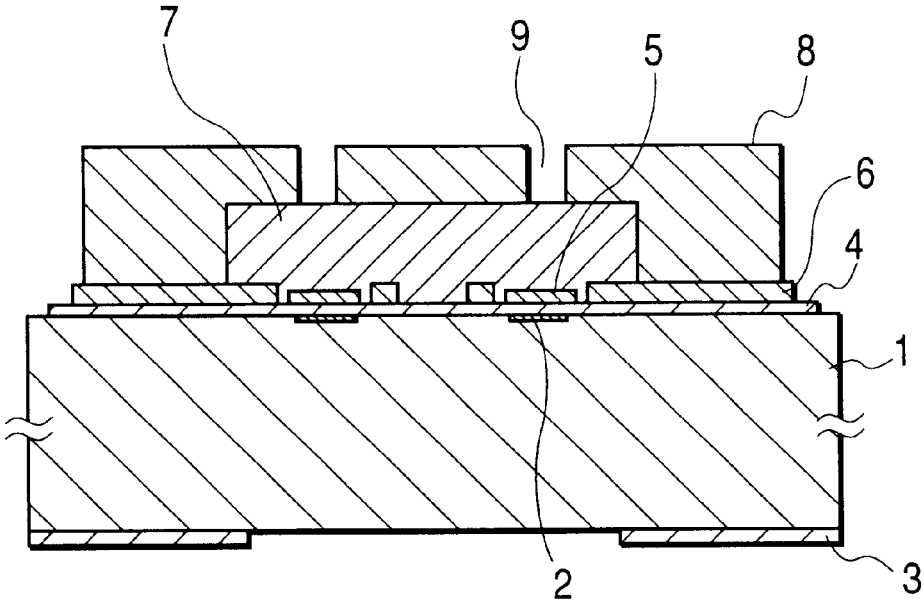
Figure 7:
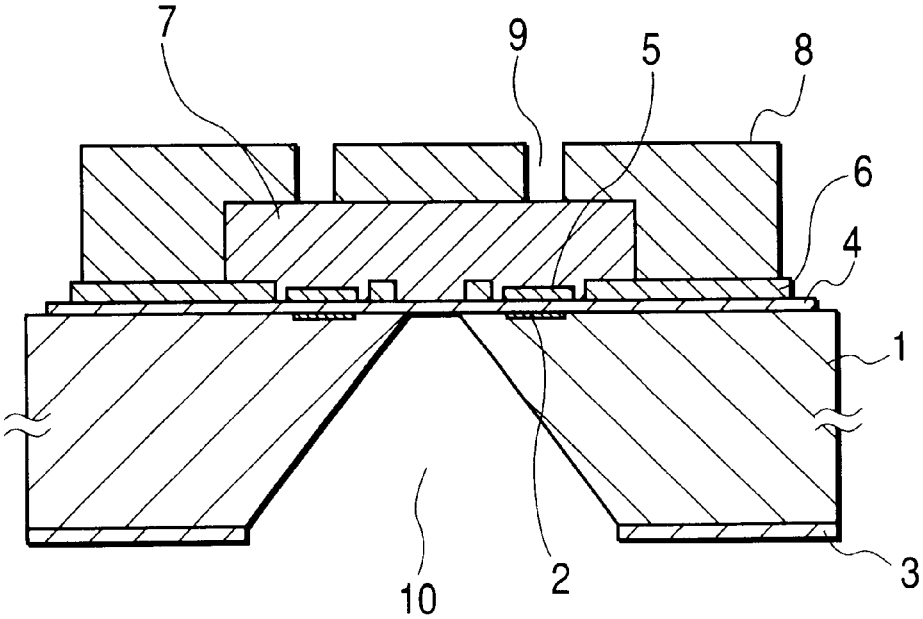

Then a coating resin layer of epoxy resin was formed so as to cover the flow path pattern 7 and the discharge ports 9 were formed by patterning to obtain the flow path forming member 8 as shown in FIG. 6. Then the substrate 1 was subjected to anisotropic Si etching to form the ink supply aperture 10 as shown in FIG. 7.

Figure 8:
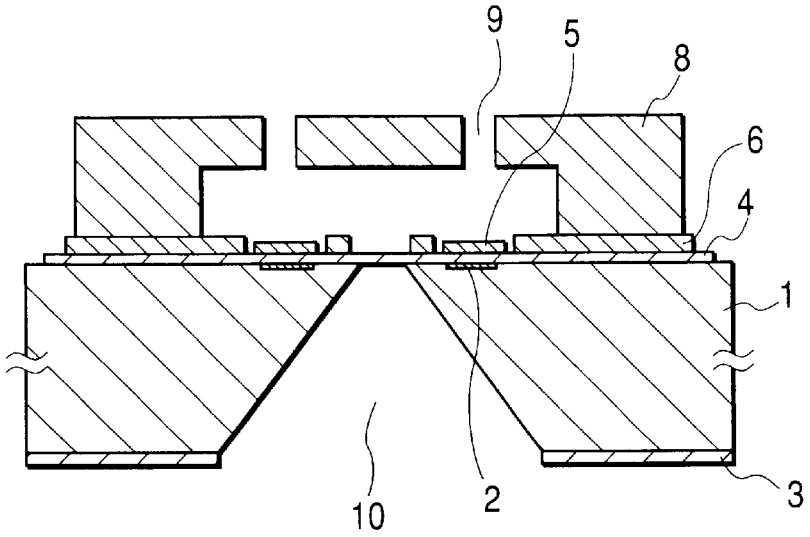

Then the SiN layer 4 was removed in a portion above the ink supply aperture 10, and the flow path pattern 7 was removed by dissolution. Then the epoxy resin layer constituting the flow path forming member 8 was completely hardened by heating for 1 hour at 180° C., whereby the ink jet head as shown in FIG. 8 was obtained.

In the ink jet head of the above-described configuration, in case the flow path forming member 8 is swelled by extended contact with the ink, the stress in the flow path forming member 8 tends to be concentrated in the front end portion of the flow path wall 11 as explained in the foregoing. Also the stress applied to the flow path forming member by the ink flow tends to be concentrated in the front end portion of the flow path wall 11. In the ink jet head of the present embodiment, the adhesion layer 6 is formed in an area wider than the flow path wall 11, at the front end portion thereof where the stress tends to be concentrated. For this reason the front end portion of the flow path wall 11 has a relatively high adhesion force, whereby the peeling of the flow path forming member 8 can be suppressed even if the stress is concentrated. Furthermore the front end portion of the flow path wall 11 can serve to absorb the stress and to relieve a portion adjoined to the Ta layer 5 of relatively weak adhesion force from excessive stress application, thereby preventing peeling, from the Ta layer 5, of the adhesion layer 6 in a state adjoined to the flow path forming member 8.

Also the overflowing portion of the adhesion layer 6 from the flow path wall 11 forms a step difference in the flow path, but such step difference is formed in a root portion of the flow path relatively distant from the discharge port 9 serving to execute the ink discharge, and such overflowing portion is relatively small. Therefore, the presence of such step difference has a relatively small influence on the ink flowability in the flow path and does not affect much the ink discharging characteristics or the ink filling characteristics at the ink filling operation after the ink discharge.

Thus the present embodiment allows to minimize the peeling between the flow path forming member 8 and the substrate 1 and to maintain the adjoining between the flow path forming member 8 and the substrate 1 in satisfactory condition over a prolonged period. Consequently there can be provided an ink jet head capable of satisfactory recording operation with high reliability even in a prolonged period of use.

The ink jet head of the present embodiment was prepared, filled with ink and subjected to a storage test for a month under a condition of 60° C. As a result, there were scarcely observed changes such as peeling between the substrate 1 and the flow path forming member 8 or formation of interference fringes on the adhesion face of the flow path forming member 8 resulting from partial peeling.

<Second Embodiment>

Figure 9A:
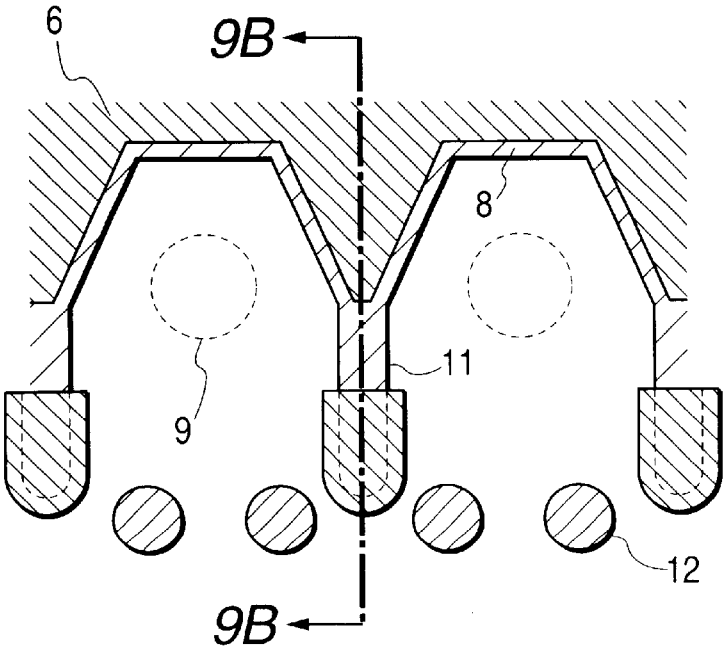
FIGS. 9A and 9B are schematic cross-sectional views showing an ink jet head constituting a second embodiment of the present invention, and are respectively a horizontal cross-sectional view showing a part in the vicinity of flow paths and a cross-sectional view along a line 9B—9B in FIG. 9A.
Figure 9B:
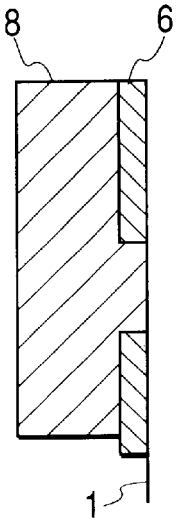

In the following there will be explained a second embodiment of the present invention with reference to FIGS. 9A and 9B which are schematic cross-sectional views showing an ink jet head constituting the second embodiment of the present invention, and are respectively a horizontal cross-sectional view showing a part in the vicinity of flow paths and a cross-sectional view along a line 9B—9B in FIG. 9A.

The ink jet head of the present embodiment is similar to that of the first embodiment except for the forming area of the adhesion layer 6, and the like portions of the present embodiment will not therefore be explained further.

Also in the ink jet head of the present embodiment, the adhesion layer 6 is formed in an area wider than the flow path wall 11 at the front end portion thereof. The adhesion layer 6 is not formed in the intermediate portion of the flow path wall 11, so that the portion of the adhesion layer 6, formed at the front end portion of the flow path wall 11, is independent from other portions.

Such pattern of the adhesion layer 6 is particularly effective in case the flow path wall 11 has a very narrow width for example in order to secure a wide flow path for obtaining desired ink flowability. In such case, it is difficult to form the adhesion layer 6 narrower than the flow path wall 11, and, even if formed, to expect an effect of increasing the adhesion force. On the other hand, it is easy to form the adhesion layer 6 wider than the flow path wall 11, and it is possible by such adhesion layer 6 to effectively increase the adhesion force at the front end portion of the flow path wall 11.

In case the width of the flow path wall 11 is very small, the flow path wall 11 has a small adjoining area so that the adjoining force thereof becomes small if without the adhesion layer 6. The presence of the adhesion layer 6 wider than the flow path wall 11 at the front end portion thereof where the adjoining force tends to become small allows to effectively increase the adjoining force of the flow path wall 11.

Also in the ink jet head of the present embodiment, the stress resulting from the swelling of the flow path forming member 8 or that resulting from the ink flow tend to be concentrated in the front end portion of the flow path wall 11, and the presence of the adhesion layer 6 in a planar area wider than the flow path wall 11 in such portion allows to prevent peeling of the flow path forming member 8. Stated differently it is rendered possible to increase the adhesion force in the front end portion of the flow path wall 11 where the stress tends to be concentrated, thereby suppressing peeling in such portion. Furthermore, the front end portion of the flow path wall 11 absorbs the stress to reduce the stress applied to other adjoining portions of the flow path forming member 8, including the portion adjoined to the Ta layer 5, thereby preventing peeling in such other portions.

Also the step difference formed by the overflowing of the adhesion layer 6 from the flow path wall 11 is present in the root portion of the flow path and such overflowing portion is small. Consequently the influence on the ink flowability in the flow path is relatively small, and the influence on the ink discharge characteristics or on the ink filling characteristics is also not so large.

The ink jet head of the present embodiment was prepared, filled with ink and subjected to a storage test for a month under a condition of 60° C. As a result, there were scarcely observed changes such as peeling between the substrate 1 and the flow path forming member 8 or formation of interference fringes on the adhesion face of the flow path forming member 8 resulting from partial peeling.

<Third Embodiment>

Figure 10A:
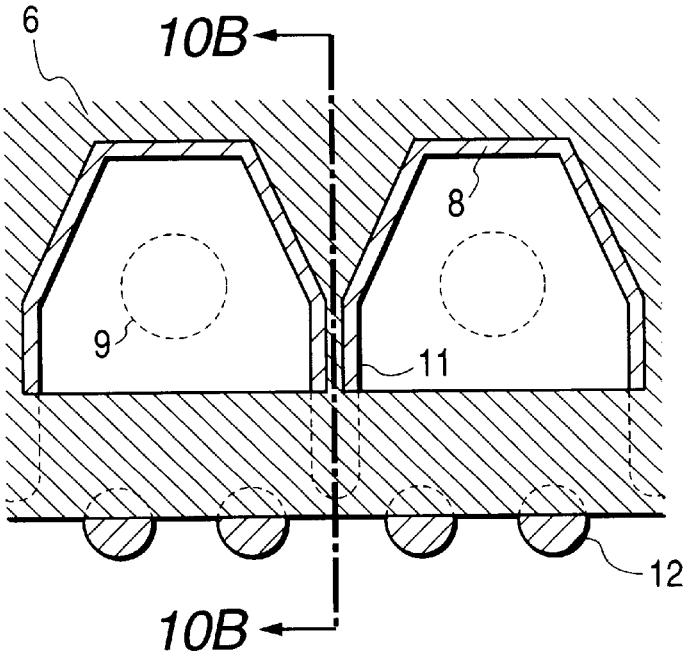
FIGS. 10A and 10B are schematic cross-sectional views showing an ink jet head constituting a third embodiment of the present invention, and are respectively a horizontal cross-sectional view showing a part in the vicinity of flow paths and a cross-sectional view along a line 10B–10B in FIG. 10A.
Figure 10B:
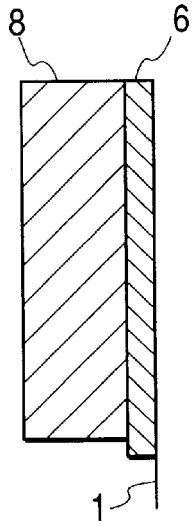

In the following there will be explained a third embodiment of the present invention with reference to FIGS. 10A and 10B which are schematic cross-sectional views showing an ink jet head constituting the third embodiment of the present invention, and are respectively a horizontal cross-sectional view showing a part in the vicinity of flow paths and a cross-sectional view along a line 10B—10B in FIG. 10A.

The ink jet head of the present embodiment is similar to that of the first and second embodiments except for the forming area of the adhesion layer 6, and the like portions of the present embodiment will not therefore be explained further.

In the ink jet head of the present embodiment, the adhesion layer 6 is formed, in the front end portion of the flow path wall 11, in a belt-like shape extending in the direction of array of the plural flow path walls 11. Such pattern of the adhesion layer 6 is particularly effective in case the ink discharge pressure generating elements 2 and the discharge ports 9 are formed with a relatively small pitch for example in order to enable pixel formation of a relatively high density, namely in case the flow path walls 11 are formed with a very small pitch. In such case, it may be easier to form the adhesion layer 6 in belt-like shape, rather than to form the adhesion layer 6 independently for each flow path wall 11. Such belt-like shaped adhesion layer 6 allows to effectively increase the adhesion force at the front end portion of the flow path wall 11.

Also in the ink jet head of the present embodiment, the stress resulting from the swelling of the flow path forming member 8 or that resulting from the ink flow tend to be concentrated in the front end portion of the flow path wall 11, and the presence of the adhesion layer 6 in a planar area wider than the flow path wall 11 in such portion allows to prevent peeling of the flow path forming member 8. Stated differently it is rendered possible to increase the adhesion force in the front end portion of the flow path wall 11 where the stress tends to be concentrated, thereby suppressing peeling in such portion. Furthermore, the front end portion of the flow path wall 11 absorbs the stress to reduce the stress applied to other adjoining portions of the flow path forming member 8, including the portion adjoined to the Ta layer 5, thereby preventing peeling in such other portions.

Also the step difference formed by the overflowing of the adhesion layer 6 from the flow path wall 11 is present in the root portion of the flow path and such overflowing portion is small. Consequently the influence on the ink flowability in the flow path is relatively small, and the influence on the ink discharge characteristics or on the ink filling characteristics is also not so large.

The ink jet head of the present embodiment was prepared, filled with ink and subjected to a storage test for a month under a condition of 60° C. As a result, there were scarcely observed changes such as peeling between the substrate 1 and the flow path forming member 8 or formation of interference fringes on the adhesion face of the flow path forming member 8 resulting from partial peeling.

In the first and second embodiments, the adhesion layer 6 is not formed in the planar area where the pillar 12 is formed, so that the pillar 12 is formed on the substrate 1 solely across the SiN layer 4. On the other hand, in the present embodiment, the belt-like shaped adhesion layer 6 formed in the front end portion of the flow path wall 11 passes a part of the formation area of the pillar 12, so that the pillar 12 is partially formed across the adhesion layer 6. The pillar 12 is provided for example for preventing dust intrusion into the flow path as explained in the foregoing and need not necessarily be completed adjoined to the substrate 1. Therefore the belt-like shaped adhesion layer 6 may be so formed as to exclude the area of the pillar 12.

Figure 11:
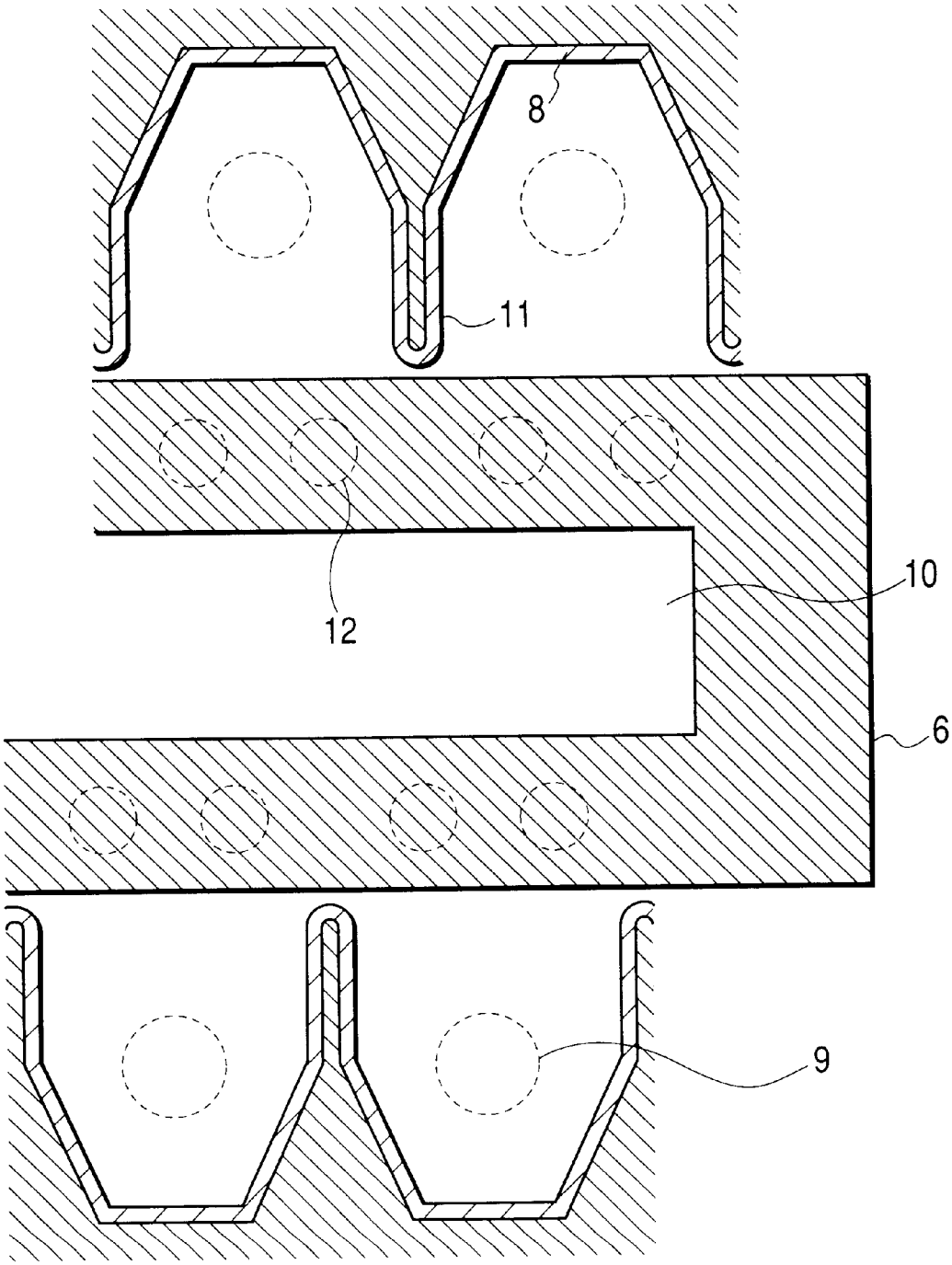
FIG. 11 is a horizontal cross-sectional view showing a part in the vicinity of the ink supply aperture in an ink jet head constituting a variation of the present invention.
Figure 12:
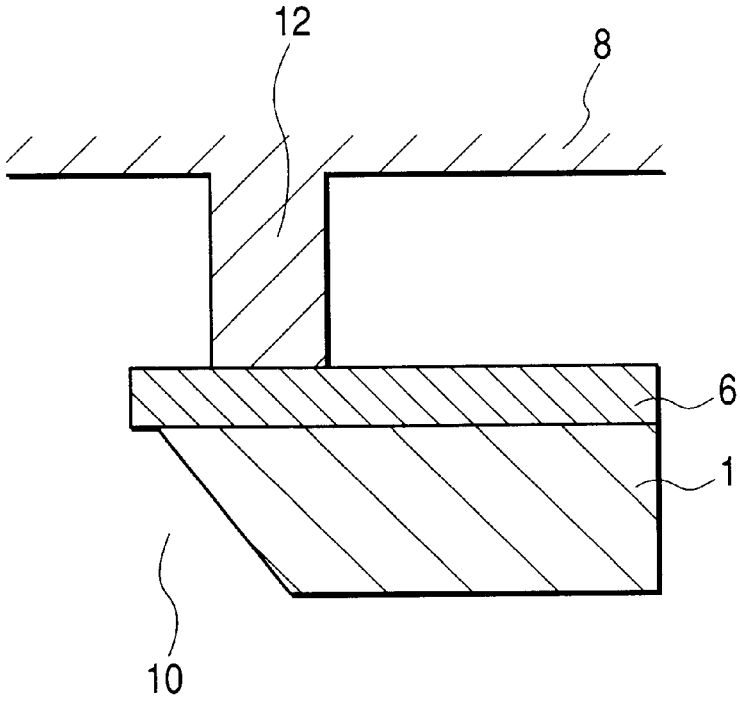
FIG. 12 is a lateral cross-sectional view showing a part in the vicinity of the ink supply aperture in the ink jet head shown in FIG. 11.
Figure 13:
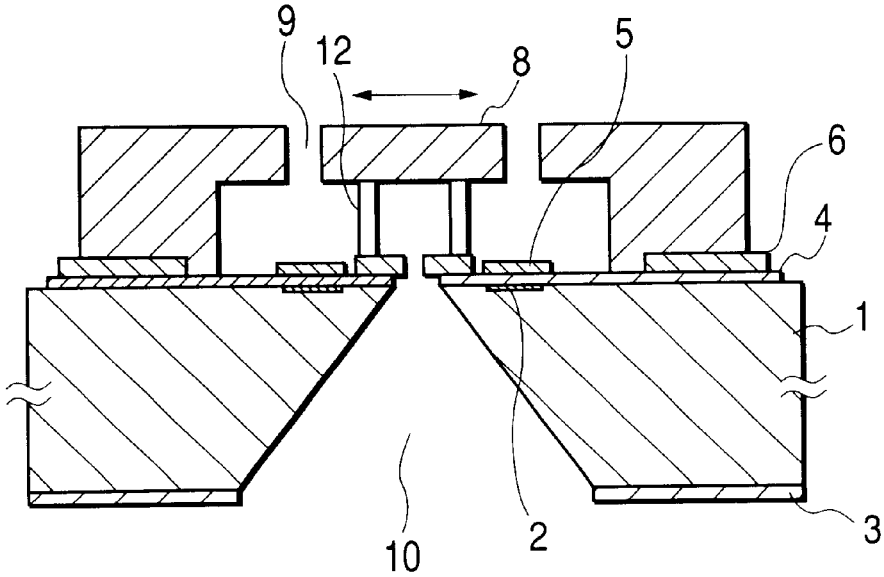
FIG. 13 is a lateral cross-sectional view of the entire ink jet head shown in FIG. 12.

Also for other reasons, the adhesion layer 6 may be formed in a planar area passing through the forming area of the pillar 12. FIGS. 11 to 13 show the ink jet head in such a variation, and are respectively a horizontal cross-sectional view showing a part in the vicinity of the ink supply aperture of such ink jet head, a lateral cross-sectional view of a part in the vicinity of the ink supply aperture, and a lateral cross-sectional view of the entire head. FIG. 11 is to show the shape of the adhesion layer 6 in the vicinity of the pillar 12 and shows, for the purpose of simplicity, a configuration in which the adhesion layer 6 is formed in an area narrower than the planar area of the flow path wall 11 at the front end portion thereof, but the adhesion layer 6 in such portion may assume the configuration in any of the foregoing first to third embodiments.

In the ink jet head of the configuration of the first to third embodiments, the ink supply aperture 10 is opened in the substrate 1 by a process of forming a through-hole as explained before. In this process, a membrane consisting of a passivation layer of antietching property is formed on the surface of the substrate 1. Such membrane may generate a fissure in any process step for producing the ink jet head such as a step of forming the adhesion layer 6 consisting of polyetheramide on the substrate 1, a step of forming the flow path pattern consisting of the soluble resin, a step of forming the coating resin layer to constitute the flow path forming member, a step of forming discharge port 9 in such coating resin layer in a position above the ink discharge pressure generating element 2 or a step of dissolving out the flow path pattern. Such fissure tends to be generated in the vicinity of the end portion of the ink supply aperture 10. Therefore, in the ink jet head of the present variation, around the rim of the ink supply aperture 10, there is provided an adhesion layer 6 for protecting the rim of the ink supply aperture, in such a manner as to slightly overflow in the ink supply aperture 10. The presence of such adhesion layer 6 allows to prevent the abnormal fissure in the membrane.

Figure 14:
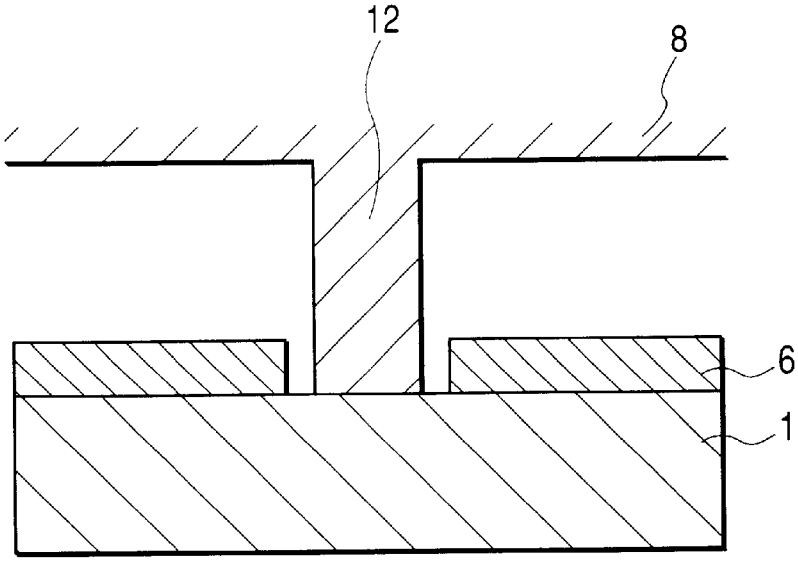
FIG. 14 is a schematic cross-sectional view showing a part in the vicinity of a pillar in an ink jet head constituting another variation of the present invention.
Figure 15:
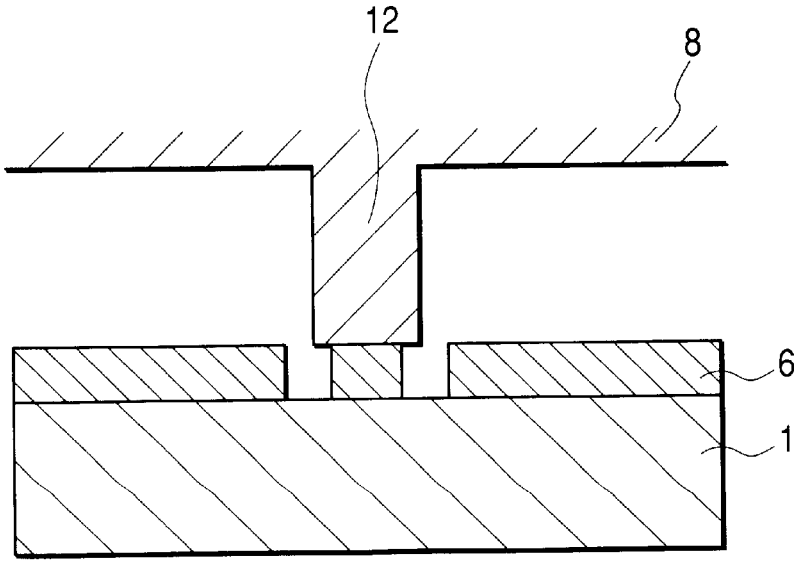
FIGS. 15 to 17 are schematic cross-sectional views showing a part in the vicinity of the pillar in an ink jet head constituting still other variations of the present invention.

In the configuration shown in FIGS. 11 to 13, the pillar 12 is adjoined to thus formed adhesion layer 6 and extends to the ceiling portion. However, the pillar 12 needs not necessarily be adjoined to the substrate 1 and the ceiling as explained in the foregoing. Therefore, there may be adopted a configuration shown in FIG. 14, in which the adhesion layer 6 is not formed in the adjoining portion of the pillar 12 to the substrate 1 and in the vicinity thereof, so that the pillar 12 is adjoined to the substrate 1 without across the adhesion layer 6. Also the adhesion layer 6 to be adjoined to the pillar 12 may be formed independently from other portions as shown in FIG. 15.

Figure 16:
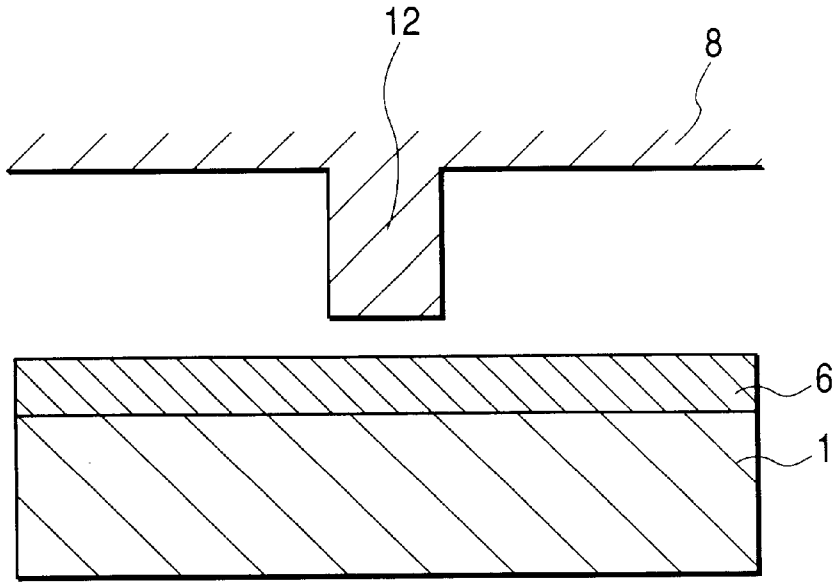

There may also be conceived a configuration in which the pillar 12 is adjoined to and supported by either of the substrate 1 and the ceiling. More specifically, there may be adopted a configuration Shown in FIG. 16 in which the pillar 12 protrudes from the ceiling portion and does not reach the adhesion layer 6.

The pillar 12 of such configuration can be obtained by executing two patternings in the step of forming the flow path pattern 7 in the aforementioned process for producing the ink jet head. More specifically, at soluble resin is coated with a thickness corresponding to the gap between the pillar 12 and the adhesion layer 6, and is patterned. In this operation, the resin is not etched in a planar position where the pillar 12 is formed. Then soluble resin is coated with such a thickness for obtaining the desired height of the flow path, including the initial coating thickness. Then the resin is etched in the planar position where the pillar 12 is formed. The pillar 12 of the configuration of the present embodiment can be obtained by coating the flow path pattern 7 formed by such two patternings with the resin for constituting the flow path forming member 8.

Figure 17:
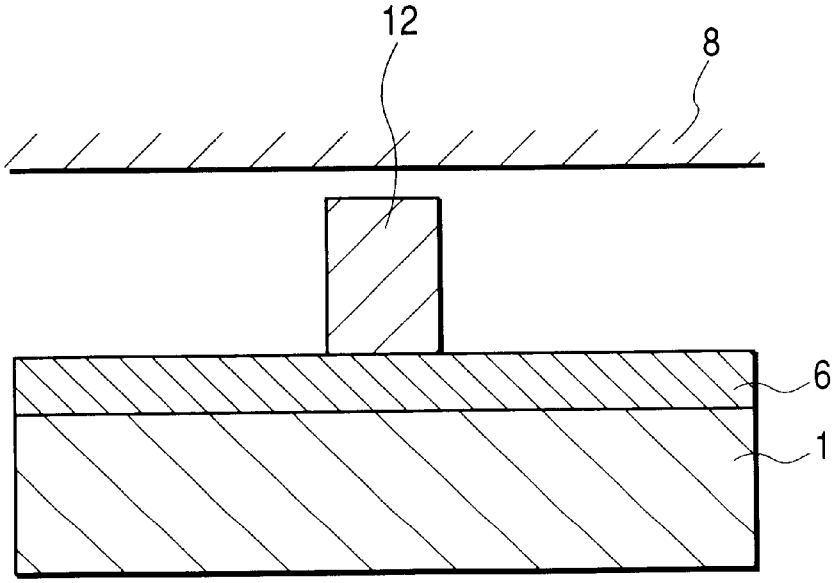

There may also be adopted a configuration shown in FIG. 17 in which the pillar 12 extends upwards from the adhesion layer 6 but does not reach the ceiling portion formed by the flow path forming member 8.

The pillar 12 of such configuration can be formed by the following steps, in the aforementioned process for producing the ink jet head, in coating the flow path pattern 7 with the resin for constituting the flow path forming member 8. At first soluble resin is coated with a thickness corresponding to the height of the pillar 12 and is patterned. In this operation, the resin is etched in the planar position of the pillar 12. Then the resin for constituting the flow path forming member 8 is coated in a recess formed in thus formed flow path pattern 7 corresponding to the forming position of the pillar 12. Then soluble resin is coated with such a thickness for obtaining the desired height of the flow path, including the initial coating thickness. Then the resin is not etched in the planar position where the pillar 12 is formed. The pillar 12 of the configuration of the present embodiment can be obtained by coating the flow path pattern 7 with the resin for constituting the flow path forming member 8.

<Explanation of Ink Jet Recording Apparatus>

In the following there will be explained an example of the ink jet recording apparatus in which the aforementioned ink jet head is mounted, with reference to FIG. 18, which is a perspective view schematically showing the configuration of such ink jet recording apparatus.

Figure 18:
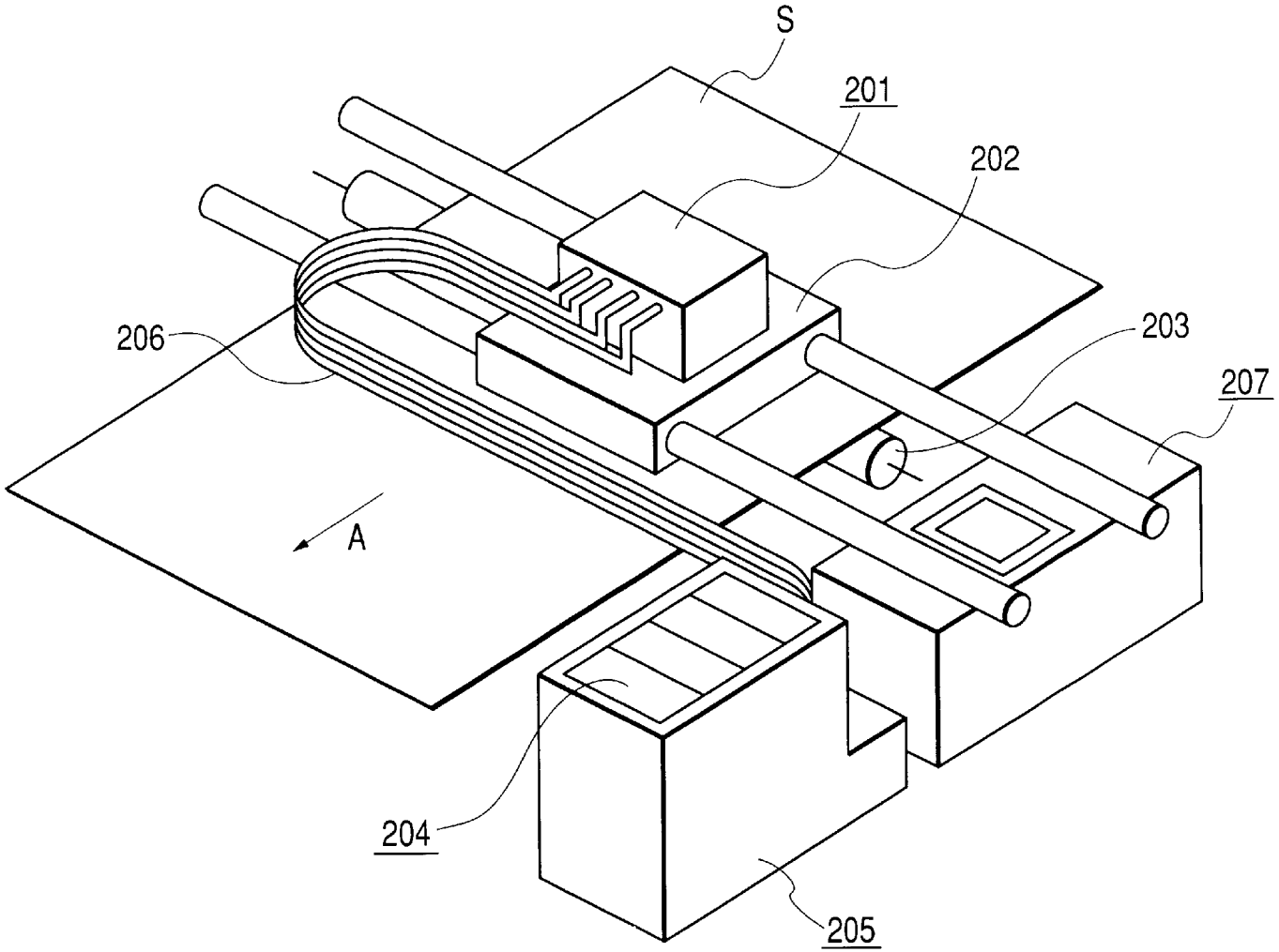
FIG. 18 is a perspective view showing the schematic configuration of an ink jet recording apparatus on which the ink jet head of the present invention can be mounted.

The ink jet recording apparatus shown in FIG. 18 is a recording apparatus of serial type, capable of repeating the reciprocating motion (main scanning) of an ink jet head 201 and the conveying (sub scanning) of a recording sheet (recording medium) S such as an ordinary recording paper, a special paper, an OHP film sheet etc. by a predetermined pitch and causing the ink jet head 201 to selectively discharge ink in synchronization with these motions for deposition onto the recording sheet S, thereby forming a character, a symbol or an image.

Referring to FIG. 18, the ink jet head 201 is detachably mounted on a carriage 202 which is slidably supported by two guide rails and is reciprocated along the guide rails by drive means such as an unrepresented motor. The recording sheet S is conveyed by a conveying roller 203 in a direction crossing the moving direction of the carriage 202 (for example a perpendicular direction A), so as to be opposed to an ink discharge face of the ink jet head 201 and to maintain a constant distance thereto.

The recording head 201 is provided with plural nozzle arrays for discharging inks of respectively different colors. Corresponding to the colors of the inks discharged from the recording head 201, plural independent main tanks 204 are detachably mounted on an ink supply unit 205. The ink supply unit 205 and the recording head 201 are connected by plural ink supply tubes 206 respectively corresponding to the ink colors, and, by mounting the main tanks 204 on the ink supply unit 205, the inks of respective colors contained in the main tanks 204 can be independently supplied to the nozzle arrays in the recording head 201.

In a non-recording area which is within the reciprocating range of the recording head 201 but outside the passing range of the recording sheet S, there is provided a recovery unit 207 so as to be opposed to the ink discharge face of the recording head 201.

Figure 19:
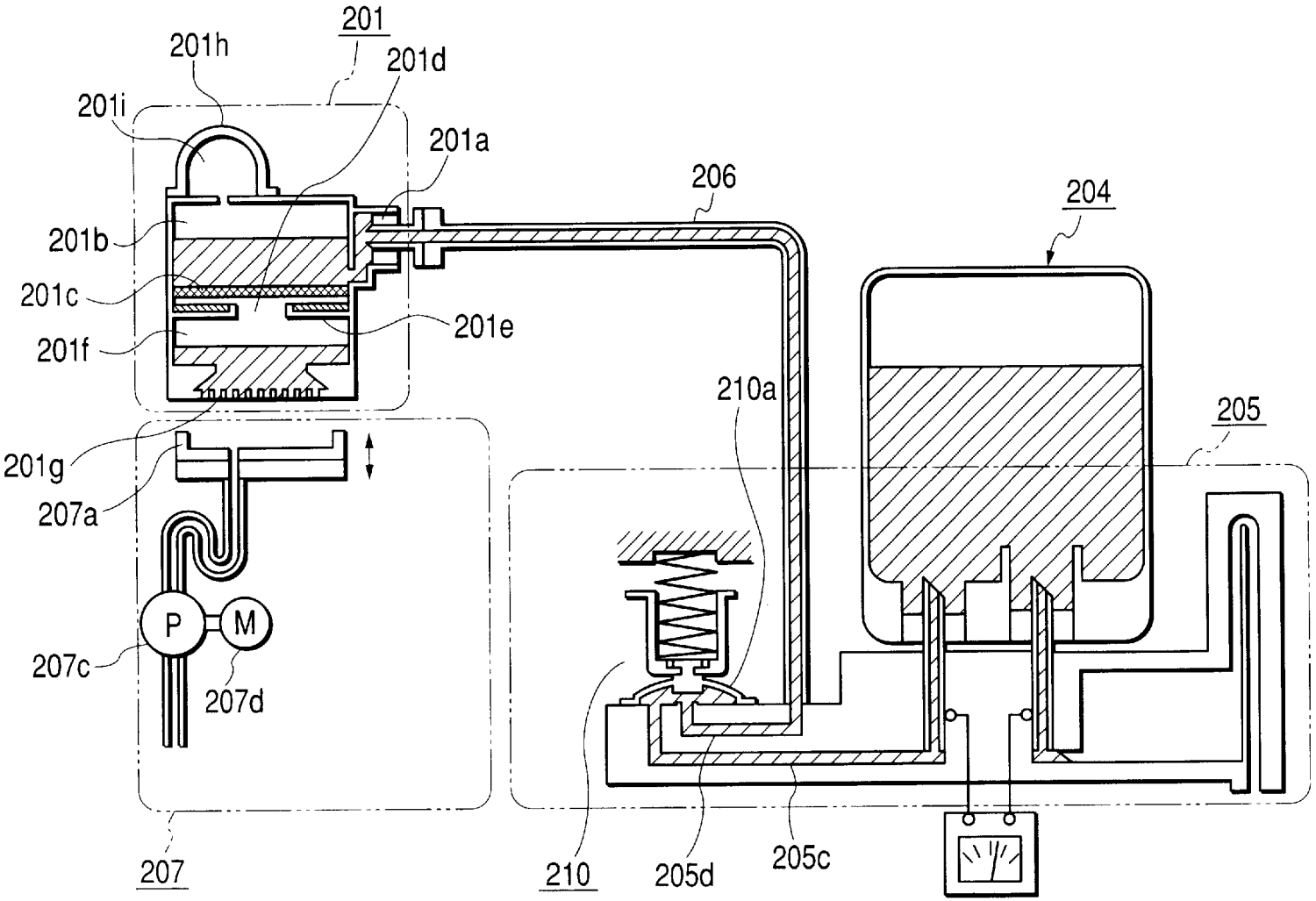
FIG. 19 is a view showing an ink supply path for a color in the ink jet recording apparatus shown in FIG. 18.
Figure 20A:
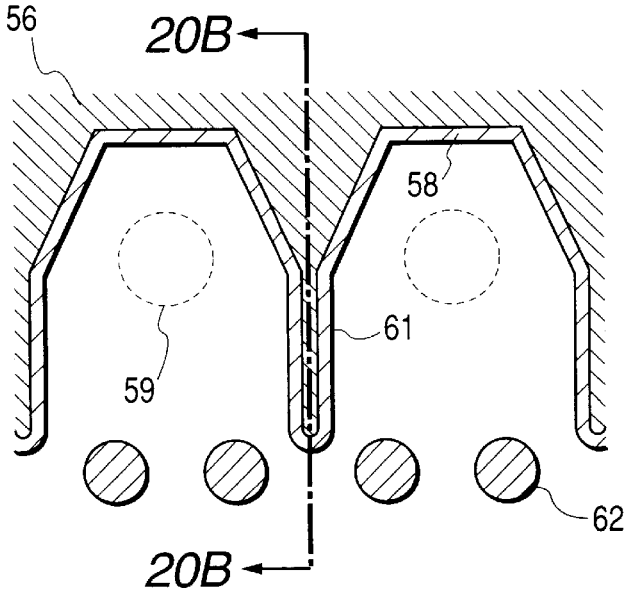
FIGS. 20A and 20B are schematic cross-sectional views of a conventional ink jet head, and are respectively a horizontal cross-sectional view showing a part in the vicinity of flow paths and a cross-sectional view along a line 20B—20B in FIG. 20A.
Figure 20B:
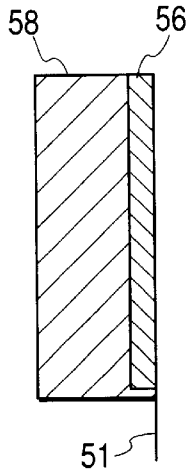
Figure 21A:
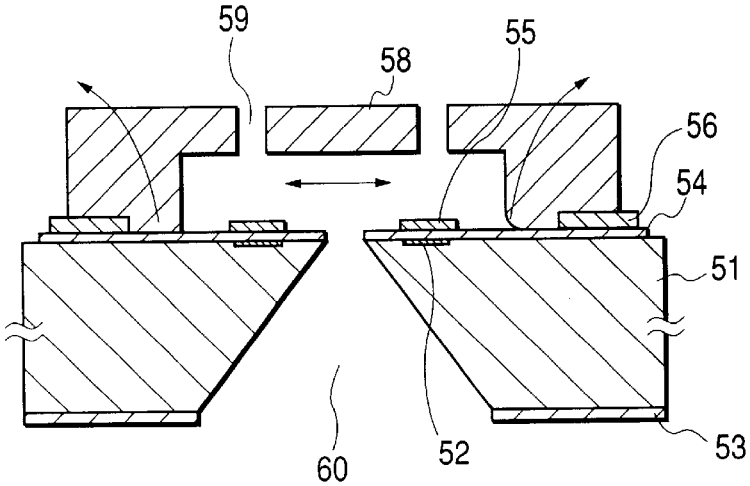
FIGS. 21A and 21B are schematic cross-sectional views of a conventional ink jet head, and are respectively a lateral cross-sectional view of the entire ink jet head and a magnified cross-sectional of the adjoining portion of the flow path forming member.
Figure 21B:
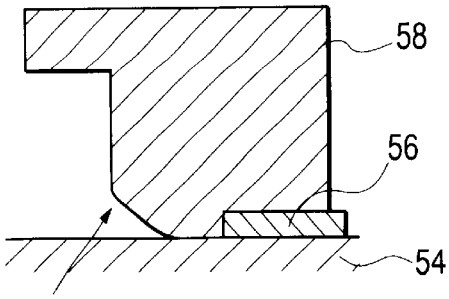
Figure 22:
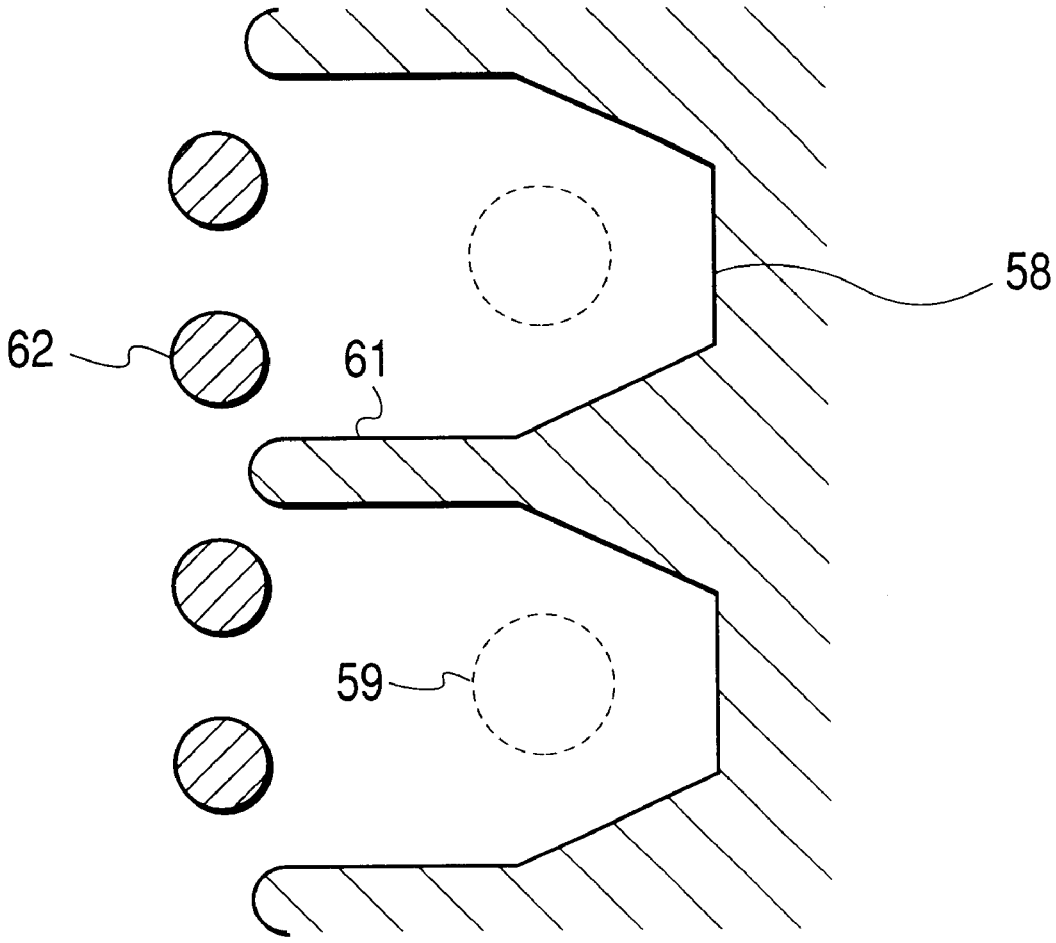
FIG. 22 is a horizontal cross-sectional view showing a part in the vicinity of the flow path in the ink jet head shown in FIGS. 21A and 21B.

In the following there will be explained, with reference to FIG. 19, the configuration of the ink supply system of the ink jet recording apparatus. FIG. 19 is a view showing the ink supply path of the ink jet recording apparatus shown in FIG. 18, showing the path for a color only for the purpose of simplicity.

Ink is supplied to the recording head 201, from a connector insertion port 201*a* to which hermetically connected is a liquid connector provided on the end of the ink supply tube 206. The connector insertion port 201*a* communicates with a sub tank 201*b* formed in the upper part of the recording head 201. In the lower side of the sub tank 201*b* in the direction of gravity, there is formed a liquid chamber 201*f* for direct ink supply to a nozzle portion having plural nozzles 201*g* arranged in parallel manner. The sub tank 201*b* and the liquid chamber 201*f* are separated by a filter 201*c*, but, at the boundary of the sub tank 201*b* and the liquid chamber 201*f* there is formed a partition portion 201*d* having an aperture 201*d*, and the filter 201*c* is provided on such partition portion 201*e*.

In the above-described configuration, the ink supplied from the connector insertion port 201*a* to the recording head 201 is supplied through the sub tank 201*b*, filter 201*c* and liquid chamber 201*f* to the nozzles 201*g*. The path between the connector insertion port 201*a* to the nozzles 201*g* is maintained in a hermetically tight condition to the atmosphere.

On the upper face of the sub tank 201*b* there is formed an aperture which is covered by a dome-shaped elastic member 201*h*. The space surrounded by the elastic member 201*h* (pressure adjusting chamber 201*i*) changes volume according to the pressure in the sub tank 201*b* and has a function of adjusting the pressure in the sub tank 201*b*.

The nozzle 201*g* is positioned with the ink discharging end downwards, and the ink fills the nozzle 201*g* by forming a meniscus. For this purpose, the interior of the recording head 201, particularly the interior of the liquid chamber 201*f*, is maintained at a negative pressure. In the present ink jet recording apparatus, the ink supply system 205 and the recording head 201 are connected by the ink supply tube 206 and the position of the recording head 201 relative to the ink supply unit 205 can be relatively freely selected, so that the recording head 201 is positioned higher than the ink supply unit 205 in order to maintain the interior of the recording head 201 at a negative pressure.

The filter 201*c* is composed of a metal mesh having fine holes smaller than the cross sectional width of the nozzle

201*g,* in order to prevent leak of a substance that may clog the nozzle 201*g,* from the sub tank 201*b* to the liquid chamber 201*f.* The filter 201*c* has such a property that, when brought into contact with liquid on one surface thereof, each fine hole forms a meniscus of the ink, whereby the ink can easily pass but the air flow through the filter becomes difficult. As the fine hole becomes smaller, the meniscus becomes stronger and the air flow becomes more difficult.

In the present ink jet recording apparatus, if air is present in the liquid chamber 201*f* positioned at the downstream side of the filter 201*c* with respect to the ink moving direction in the recording head 201, such air cannot pass through the filter 201*c* by the floating force of the air itself. Utilizing such phenomenon, the liquid chamber 201*f* is not fully filled with the ink but an air layer is formed between and separates the ink in the liquid chamber 201*f* and the filter 201*c* thereby storing the ink of a predetermined amount in the liquid chamber 201*f.*

In the recording apparatus of serial type as in the present configuration, the ink discharge is interrupted at the inversion of the motion of the carriage 202 (cf. FIG. 18) even in a high-duty image formation. The pressure adjusting chamber 201*i* performs a function similar to that of a capacitor, by reducing its volume during the ink discharge operation to relax the increase in the negative pressure in the sub tank 201*b* and restoring the volume at such inversion of the motion.

The ink supply needle 205*a* is provided with a shut-off valve 210 having a rubber diaphragm 210*a* which is displaced to open or close the connection between the two liquid paths 205*c,* 205*d.* The shut-off valve 210 is opened during the ink discharge from the recording head 201 but is closed during a stand-by state or in a non-operated state. The configuration of the ink supply unit 205 is provided for each ink color, but the shut-off valves 210 are simultaneously opened or closed for all the ink colors.

In the above-described configuration, when the ink is consumed in the recording head 201, the resulting negative pressure causes the ink to be from time to time supplied from the main tank 204 to the recording head 201 through the ink supply unit 205 and the ink supply tube 206.

The recovery unit 207 is used for sucking ink and air from the nozzle 201*g,* and is provided with a suction cap 207*a* for capping the ink discharge face (face including the aperture of the nozzle 201*g*) of the recording head 201. The suction cap 207*a* is composed of an elastic member such as of rubber at least in a portion coming into contact with the ink discharge face, and is rendered movable between a position closing the ink discharge face and a position retracted from the recording head 201. The suction cap 207*a* is connected to a tube including therein a suction pump 207*c* of tube pump type, and is capable of continuous suction by the activation of the suction pump 207*c* by a pump motor 207*d.* The suction amount can be varied according to the revolution of the pump motor 207*d.*

In the foregoing there has been explained the ink supply path from the main tank 204 to the recording head 201, but, in the configuration shown in FIG. 19, the air inevitably accumulates in the recording head 201 over a prolonged period.

In the sub tank 201*b,* there is accumulated air which permeates through the ink supply tube 206 or the elastic member 201*h,* or is dissolved in the ink. The air permeation through the ink supply tube 206 or the elastic member 201*h* can be prevented by employing a material of high gas barrier property for these components, but such material is expensive and it is difficult to utilize a high performance material in the mass produced consumer equipment in consideration of the cost.

On the other hand, in the liquid chamber 201*f,* the air accumulates gradually by fission of the bubble generated by film boiling of the ink at the ink discharge and returning of such bubble to the liquid chamber 201*f,* or by gathering of small bubbles, dissolved in the ink, to a large bubble in response to a temperature increase of the ink in the nozzle 201*g.*

The air accumulation in the sub tank 201*b* and the liquid chamber 201*f* reduces the ink amount therein. In the sub tank 201*b,* an ink deficiency causes exposure of the filter 201*c* to the air, thereby increasing the pressure loss thereof and eventually disabling ink supply to the liquid chamber 201*f.* Also an ink deficiency in the liquid chamber 201*f* causes exposure of the upper end of the nozzle 201*g* to the air, thereby rendering ink supply thereto impossible. In this manner, a fatal situation arises unless each of the sub tank 201*b* and the liquid chamber 201*f* contains ink at least equal to a predetermined amount.

Therefore, by filling each of the sub tank 201*b* and the liquid chamber 201*f* with an appropriate amount of ink at a predetermined interval, the ink discharging performance can be stably maintained over a long period, even without employing the material of high gas barrier property.

The ink filling into the sub tank 201*b* and the liquid chamber 201*f* is executed utilizing the suction operation by the recovery unit 207. More specifically, the suction pump 207*c* is activated in a state where the ink discharge face of the recording head 201 is tightly closed by the suction cap 207*a,* thereby sucking the ink in the recording head 201 from the nozzle 201*g.* However, in simple ink suction from the nozzle 201*g,* ink of an amount approximately equal to the ink sucked from the nozzle 201*g* flows from the sub tank 201*b* into the liquid chamber 201*f* and ink of an amount approximately equal to that flowing out of the sub tank 201*b* flows from the main tank 204 into the sub tank 201*b,* so that the situation does not change much from the state prior to suction.

Therefore, in the present embodiment, in order to fill the sub tank 201*b* and the liquid chamber 201*f* separated by the filter 201*c* respectively with appropriate amounts of ink, the sub tank 201*b* and the liquid chamber 201*f* are reduced to a predetermined pressure utilizing the shut-off valve 210, thereby setting the volumes of the sub tank 201*b* and the liquid chamber 201*f.*

In the following there will be explained the ink filling operation of the sub tank 201*b* and the liquid chamber 201*f,* and the volume setting thereof.

In the ink filling operation, at first the carriage 202 (cf. FIG. 18) is moved to a position where the recording head 201 is opposed to the suction cap 207*a,* and the ink discharge face of the recording head 201 is closed by the suction cap 207*a.* Also the shut-off valve 210 is closed to shut off the ink path from the main tank 204 to the recording head 201.

The pump motor 207*d* is activated in this state to execute suction by the suction pump 207*c* from the suction cap 207*a.* This suction operation sucks ink and air, remaining in the recording head 201, through the nozzle 201*g,* thereby reducing the pressure in the recording head 201. The suction pump 207*c* is stopped when the suction reaches a predetermined amount. Then the ink discharge face remains in the closed state by the suction cap 207*a* but the shut-off valve 210 is opened. The suction amount of the suction pump 207*c* is so selected as to bring the interior of the recording head 201 to a predetermined pressure required for filling the sub tank 201*b* and the liquid chamber 201*f* with ink of appropriate amounts, and can be determined by calculation or by experiment.

As the internal pressure of the recording head 201 is reduced, ink flows into the recording head 201 through the ink supply tube 206, thereby filling each of the sub tank 201*b* and the liquid chamber 201*f* with ink. The amount of ink filling corresponds to a volume required for returning the sub tank 201*b* and the liquid chamber 201*f* to the atmospheric pressure, and is determined by the volume and pressure thereof.

The ink filling into the sub tank 201*b* and the liquid chamber 201*f* is completed in a short time such as about 1 second after opening the shut-off valve 210. Upon completion of the ink filling, the suction cap 207*a* is separated from the recording head 201, and the suction pump 207*c* is activated again to suck the ink remaining in the suction cap 207*a*. The ink filling operation is completed in this manner.

Now, let us consider the relationship among the volume V1 of the sub tank 201*b*, the ink amount S1 to be filled therein and the pressure P1 (relative to the atmospheric pressure) therein. Based on the law "PV=constant", the sub tank 201*b* can be filled with the ink of an appropriate amount in the filling operation, by setting a relation V1=S1/|P1|. Similarly, for the volume V2 of the liquid chamber 201*f*, the ink amount S2 to be filled therein and the pressure P2 (relative to the atmospheric pressure) therein, the liquid chamber 201*f* can be filled with the ink of an appropriate amount in the filling operation, by setting a relation V2=S2/|P2|.

By setting the volumes and reduced pressures in the sub tank 201*b* and the liquid chamber 201*f* as explained in the foregoing, it is rendered possible to fill the sub tank 201*b* and the liquid chamber 201*f*, separated by the filter 201*c*, with the inks of respectively appropriate amounts in a single filling operation, and to achieve normal operation of the recording head 201 over a long period without executing the suction operation, even under a situation where the air accumulates in the recording head 201.

In the above-described ink jet recording apparatus, the ink filling operation is executed by reducing the pressure in the recording head 201 by the suction pump 207*c* in a state where the shut-off valve 201 is closed, and then opening the shut-off valve 210. In such ink filling operation, the ink is filled within a short time as explained in the foregoing, and a relatively strong ink flow is generated in the recording head 201. In such operation, the ink flow applies a relatively strong stress to the flow path forming member, but the present invention allows to prevent the peeling of the flow path forming member also in such ink filling operation.

The ink jet recording apparatus in which the ink jet head of the present invention is to mounted is not limited to that explained in the foregoing. There has been explained an ink jet recording apparatus of serial type, but the present invention is likewise applicable to an ink jet recording apparatus of line type, provided with an ink jet head including a nozzle array over the entire width of the recording medium.

What is claimed is:

1. An ink jet head comprising:

a substrate bearing a liquid discharge pressure generating element for generating energy for discharging liquid from a discharge port;

a flow path forming member adjoined to said substrate and forming a flow path communicating with said discharge port through a position on said liquid discharge pressure generating element; and an adhesion layer formed in at least a part between said substrate and said flow path forming member and having an adhesion force with respect to said substrate and said flow path forming member larger than an adhesion force between said flow path forming member and said substrate;

wherein said adhesion layer is formed, in a portion where the stress in said flow path forming member is concentrated in a direction of peeling from said substrate, in an area wider than an adjoining area between said flow path forming member and said adhesion layer.

2. An ink jet head comprising:

a substrate bearing a liquid discharge pressure generating element for generating energy for discharging liquid from a discharge port;

a flow path forming member adjoined to said substrate and forming a flow path communicating with said discharge port through a position on said liquid discharge pressure generating element;

a common liquid chamber formed by said flow path forming member and adapted for containing the liquid to be supplied to said discharge port;

a flow path wall formed by said flow path forming member, said flow path wall extending toward said common liquid chamber and defining said flow path; and an adhesion layer formed between at least a part of said substrate and at least a part of said flow path forming member, wherein, at an end portion of said flow path wall at a side of said common liquid chamber, said adhesion layer is formed so as to adjoin said flow path wall and so as to extend over an area wider than an area at which said adhesion layer adjoins said flow path wall.

3. An ink jet head according to claim 2, wherein, in a portion at a root side of said flow path wall, said adhesion layer is formed in an inner region of said flow path wall.

4. An ink jet head according to claim 3, wherein a portion of said adhesion layer formed at said end portion of said flow path wall at said side of said common liquid chamber is formed in a belt-like shape continuous with a portion of said adhesion layer formed at an end portion of an adjacent flow path wall at said side of said common liquid chamber.

5. An ink jet head according to claim 3, wherein a portion of said adhesion layer formed at said end portion of said flow path wall at said side of said common liquid chamber is independent from a portion of said adhesion layer formed at said root side of said flow path wall.

6. An ink jet head according to claim 2, further comprising a pillar formed by said flow path forming member, in the vicinity of a portion of said common liquid chamber that communicates with said flow path.

7. An ink jet head according to claim 6, wherein a portion of said adhesion layer is formed between said pillar and said substrate.

8. An ink jet head according to claim 7, wherein said portion of said adhesion layer formed between said pillar and said substrate is independent from another portion of said adhesion layer.

9. An ink jet head according to claim 7, wherein said pillar extends from a ceiling portion formed by said flow path forming member toward said substrate to a position distanced from said portion of said adhesion layer formed between said pillar and said substrate.

10. An ink jet head according to claim 7, wherein said substrate includes a liquid supply aperture communicating with said common liquid chamber, and said portion of said adhesion layer formed between said pillar and said substrate also extends to an area surrounding a rim of said liquid supply aperture and extends partly within an area of said liquid supply aperture.

11. An ink jet head according to claim 6, wherein said adhesion layer is not formed in an area where said pillar adjoins said substrate.

12. An ink jet head according to claim 6, wherein said pillar extends from said adhesion layer toward a ceiling portion formed by said flow path forming member, to a position distanced from said ceiling portion.

13. An ink jet head according to claim 2, wherein said adhesion layer is not formed in a position over said liquid discharge pressure generating element.

14. An ink jet head according to claim 2, wherein said adhesion layer is composed of polyetheramide resin.

15. An ink jet head according to claim 14, wherein said adhesion layer is composed of thermoplastic polyetheramide resin.

16. An ink jet head according to claim 2, wherein said flow path forming member is composed of a resinous material.

17. An ink jet head according to claim 16, wherein said flow path forming member is composed of a cationic polymerized substance of epoxy resin.

18. An ink jet head according to claim 2, wherein said discharge port is formed in a position opposed to said liquid discharge pressure generating element.

19. An ink jet head according to claim 2, wherein said liquid discharge pressure generating element is an electrothermal converting member.

20. A method for producing the ink jet head according to claim 1 or claim 2, comprising the steps of:

coating the substrate with a resinous material for constituting the adhesion layer and patterning the resinous material in a predetermined planar shape to form the adhesion layer;

coating thereon a soluble resinous material and patterning the soluble resinous material into a predetermined planar shape to form a flow path pattern;

coating thereon another resinous material for constituting the flow path forming member;

opening the discharge port in the resinous material constituting the flow path forming member; and dissolving out the flow path pattern.

21. An ink jet head producing method according to claim 20, wherein the resinous material constituting the adhesion layer is composed of polyetheramide resin and a layer composed of the polyetheramide resin coated on the substrate is patterned by oxygen plasma ashing.

22. An ink jet recording apparatus, wherein an ink jet head according to claim 1 or 2 is mounted.

* * * * *

UNITED STATES PATENT AND TRADEMARK OFFICE

CERTIFICATE OF CORRECTION

PATENT NO. : 6,676,241 B2
DATED : January 13, 2004
INVENTOR(S) : Kenji Yabe

It is certified that error appears in the above-identified patent and that said Letters Patent is hereby corrected as shown below:

Title page,
Item [56], References Cited, FOREIGN PATENT DOCUMENTS, “61 154947” should read -- 61-154947 --; and “3 184868” should read -- 3-184868 --.

Column 3,
Line 29, “33” should read -- 22 --.

Column 7,
Line 44, “cross-sectional” should read -- cross-sectional view --; and
Line 63, “view” should read -- views --.

Column 12,
Line 20, “completed” should read -- completely --; and
Line 62, “needs” should read -- need --.

Column 13,
Line 1, “without across” should read -- without contacting --; and
Line 14, “at soluble” should read -- a soluble --.

Column 14,
Line 38, “partition portion 201d” should read -- partition portion 201e. --; and
Line 67, “cross sectional” should read -- cross-sectional --.

Column 15,
Line 66, “mass produced” should read -- mass-produced --.

Column 17,
Line 39, “shut-off value 201” should read -- shut-off value 210 --; and
Line 48, “to mounted” should read -- to be mounted --.

UNITED STATES PATENT AND TRADEMARK OFFICE

CERTIFICATE OF CORRECTION

PATENT NO. : 6,676,241 B2
DATED : January 13, 2004
INVENTOR(S) : Kenji Yabe

It is certified that error appears in the above-identified patent and that said Letters Patent is hereby corrected as shown below:

Column 18,
Line 56, “substrate” should read -- substrate, --.

Column 20,
Line 25, “2” should read -- claim 2 --.

Signed and Sealed this

Twentieth Day of July, 2004

JON W. DUDAS
*Acting Director of the United States Patent and Trademark Office*